US005392689A

United States Patent [19]

Buzzeo et al.

[11] Patent Number: 5,392,689

[45] Date of Patent: Feb. 28, 1995

[54] RECOIL MECHANISM FOR HANDGUNS

[75] Inventors: David J. Buzzeo, Bloomfield, Conn.; Milton W. Erickson, Merrillan, Wis.

[73] Assignee: Smith & Wesson Corp., Springfield, Mass.

[21] Appl. No.: 201,665

[22] Filed: Feb. 25, 1994

[51] Int. Cl.[6] ..... F41A 3/86; F41A 3/78

[52] U.S. Cl. ..... 89/196; 89/199

[58] Field of Search ..... 89/198, 199, 11, 15, 89/196, 163

[56] References Cited

U.S. PATENT DOCUMENTS 2,139,203 12/1938 Petter ..... 42/4
3,756,121 9/1973 Roy ..... 89/196
4,173,169 11/1979 Yates et al. ..... 89/132
4,553,469 11/1985 Atchisson ..... 89/191.02
4,754,689 7/1988 Grehl ..... 89/196
5,050,480 9/1991 Knight, Jr. et al. ..... 89/147

*Primary Examiner*—Charles T. Jordan
*Assistant Examiner*—Christopher K. Montgomery
*Attorney, Agent, or Firm*—Chapin, Neal & Dempsey

[57] ABSTRACT

A recoil mechanism used to return the slide of a semi-automatic handgun back to its battery position after firing is provided having a recoil spring, a rod member and a discrete flange member. The rod and the flange member each of polymeric material have a flange at one end thereof which retain the recoil spring disposed therebetween. The recoil mechanism is assembled by coaxially fitting the recoil spring onto the rod and then snap fitting the flange member onto the one end of the rod.

9 Claims, 1 Drawing Sheet

RECOIL MECHANISM FOR HANDGUNS

FIELD OF THE INVENTION

This invention relates to recoil mechanisms for firearms such as semi-automatic handguns in which a recoil spring is coaxially disposed on a rod and more particularly to the construction of the rod for ease of assembly of the recoil spring and the rod during the manufacture of such handguns.

BACKGROUND OF THE INVENTION

Recoil mechanisms having a recoil spring disposed on a rod retained thereon by collars or flanges disposed on opposite ends of the rod are disclosed in U.S. Pat. Nos. 2,139,203 and 5,050,480. Patent '203 discloses a guide rod having flanges at both ends of the rod which are attached thereto by tapered pins. Patent '480 discloses a guide rod with an enlarged end followed by a washer to form a collar and at the other end of the rod, a flange is secured thereto by a tapered pin with an inner and an outer drive spring disposed between the flange and the collar. Each of these recoil mechanisms requires the use of a number of parts and a plurality of manipulations in assembly thereof that makes the assembly process relatively time consuming and costly.

A semi-automatic pistol manufactured by Glock, Inc. has a recoil mechanism having a guide rod and a flange button molded of a polymeric material. The guide rod has a flange at one end thereof and an axial bore that extends over the full length of the rod and includes an interlocking recess at the other end thereof. A separate fitting that includes a flange at one end thereof and an axially extending male coupling adapted to fit into the bore of the guide rod and interlock with a protrusion therein. To assemble the recoil mechanism, the recoil spring is axially fitted onto the rod and then the male coupling is urged into the bore of the rod at the other end thereof and which interlocks with the protrusion therein.

The guide rod used in the Glock has a number of drawbacks. First, the rod is difficult to mold due to the length of the through-bore. In addition, the rod must also be fabricated to have sufficient resilience to yield radially upon insertion of the male coupling of the fitting into the bore past the protrusion therein which is radially yieldable and has sufficient resilience to fully return to its original shape so as to lock the fitting therein. Because of such resilience, the rod has a tendency to be deflected or bowed and during operation is subjected to uneven wear which may result in reducing the life of the recoil mechanism.

SUMMARY OF THE INVENTION

Accordingly, it is the general object of the present invention to provide a recoil mechanism that overcomes the drawbacks of the prior art.

It is another object to simplify the manufacture and assembly of the recoil mechanism.

It is a further object to provide an inexpensive, long wearing, and reliable recoil mechanism.

According to the present invention, an improved recoil mechanism includes a recoil spring, a rod member of polymeric material, and a discrete flange of polymeric material. The rod is of solid internal cross-section over its length and has a flange integral therewith at one end, which serves as a seat for one end of the recoil spring. At its other end, the rod has a shank portion.

The discrete flange member lo has a centrally disposed socket portion adapted for snap-fitting onto the shank portion of the rod which serves as a seat for the other end of the recoil spring.

The above and other objects and advantages of this invention will become more readily apparent when the following description is read in conjunction with the accompanying drawings.

DETAILED DESCRIPTION OF THE PREFERRED EMBODIMENTS

Figures 1, 2, 3, 4:
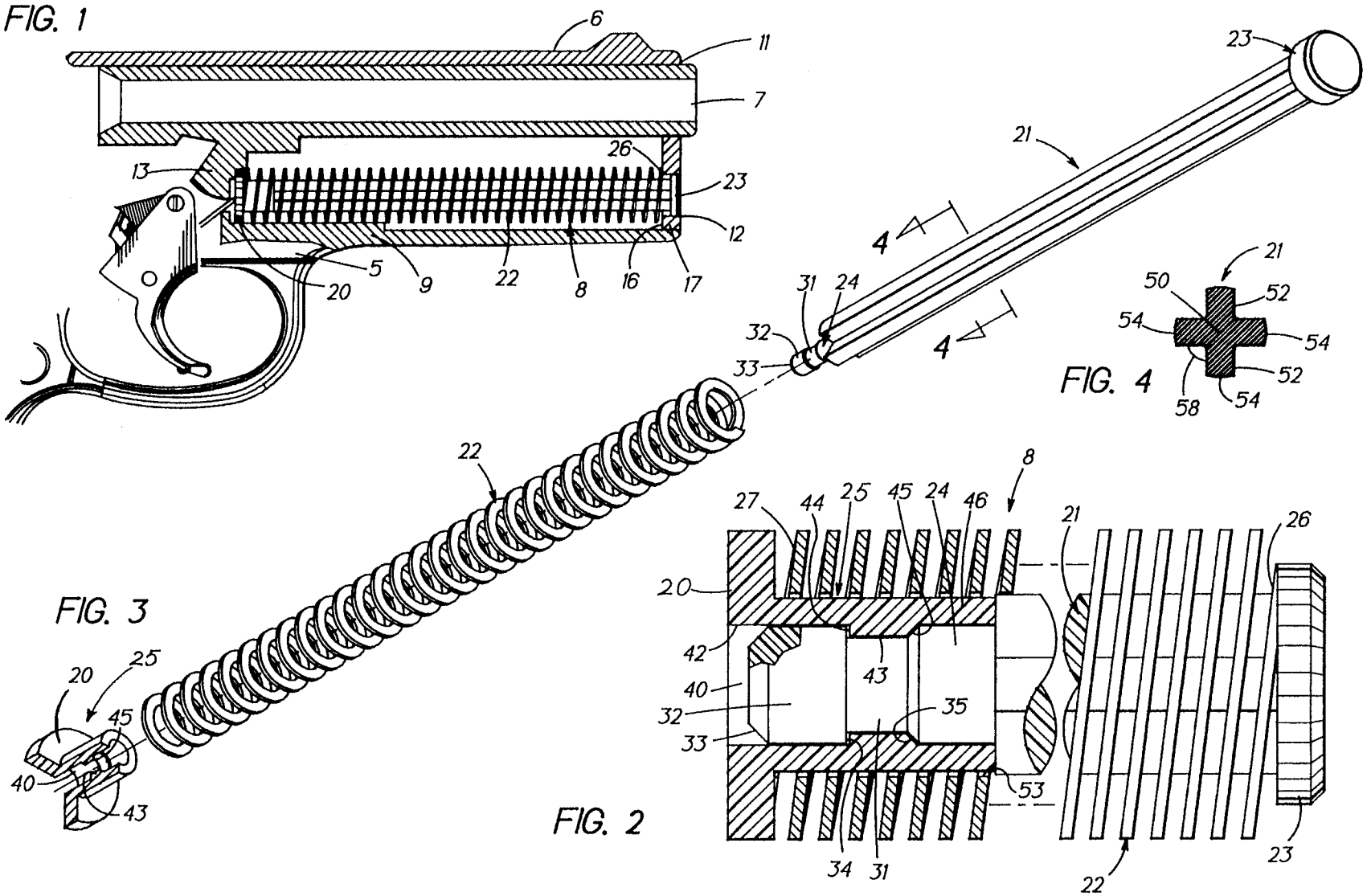
FIG. 1 is a partially cross-sectioned side elevational view of a portion of a handgun which incorporates the present invention.
FIG. 2 is a partially cross-sectional view, on an enlarged scale, of the recoil mechanism of the present invention.
FIG. 3 is an exploded view of the recoil mechanism of FIG. 2.
FIG. 4 is a cross-sectional view of the rod member taken along the line 4—4 of FIG. 3.

Referring to FIG. 1, for the purpose of explaining this invention, the parts of a firearm, specifically semi-automatic handguns, with which the recoil mechanism 8 of the present invention interacts are the frame 5, the slide 6, and the barrel 7. The barrel 7 is mounted in the front portion of the slide 6 with the recoil mechanism disposed below the barrel and slide. The slide is reciprocally disposed onto the frame by the frame guides 9.

As shown in FIG. 1, one end of the slide 6 has an opening 11 which receives the outer end of the barrel 7 and a depending portion 17 with another opening 12 which receives a flange 23 on the outer end of the recoil mechanism 8. The barrel has a notched protrusion 13 extending downward from the rear portion thereof and is adapted to retain the flange 20 therein. The recoil mechanism includes a recoil spring 22 disposed on a rod 21 and which is retained thereon by the flanges 20 and 23 disposed on opposite ends thereof. The flange 23 of the recoil mechanism is disposed in the opening 12 of the slide so that the outer end 26 of the recoil spring is disposed against the inner surface 16 of the depending portion 17 of the slide. The recoil spring will be compressed sufficiently when the firearm is in its battery position, as shown in FIG. 1, to hold the recoil mechanism in place between the slide and the notched portion of the barrel.

When the gun is fired, the slide 6 will be moved rearward along the frame guides 9 by "blow back" thereby compressing the recoil spring 22 between the depending portion 17 of the slide and the flange 20 of the recoil mechanism until the kinetic energy of the slide is exhausted by work done in moving the slide, by compressing the recoil spring and which is lost as friction at which time, the slide will stop. At this point in the cycle, the recoil spring begins to expand and thereby return the slide forward to the battery position.

As best shown in FIGS. 2 and 3, the recoil mechanism 8 comprises a discrete female coupling member 25, a rod 21, and a recoil spring 22. The rod 21 is an elongated member having the flange 23 integrally formed at one end, and as best illustrated in FIG. 4, has a cruciform body portion that extends from the flange 23 to a shank 24 at the other end thereof. The shank is generally cylindrical and has an outer diameter smaller than O.D. of the body portion. The shank comprises a head 32 with a chamfer at its outer or leading edge 33 and the head is followed by an annular recess, groove or neck portion 31 having a reduced outer diameter. The inner, or trailing, edge 34 of the head 32 is generally perpendicular to the axis of the rod, while at its inner end, the neck 31 is beveled outwardly to the O.D. of the shank 24.

Except for the flange and the shank, the rod is of a cruciform cross-sectional configuration, as shown in FIG. 4. The cruciform body of the rod comprises a central core 50 of solid cross-section and from which extend radially, at 90° intervals to each other, four radial beam portions 52 of generally rectangular configuration. The outer end surface 54 of each of the beams is cylindrical about a centerline corresponding to that of the core 50 which means that the outer stirfaces 54 of the beams 52 define spaced portions of a cylindrical stirface that is coaxial with the inner edge surfaces 53 of the spring 22. This rod construction provides outwardly open sectors or voids 58 between adjacent side surfaces of each adjacent pair of beams 52 which extend over the full length of the cruciform body portion of the rod. This construction provides for a rod of very light weight that requires less material in its fabrication but nonetheless possesses great strength and stiffness and which is less subject to being bowed or deflected when in operation. In addition, the voids 58 provide air spaces for superior heat dissipation than for other non-metallic recoil rods.

The shank portion 24 of the rod 21 serves a male coupling for interfitting with a tubular portion or socket 40 of the coupling member 25. The shank, unlike the female coupling on the end of the recoil rod in the prior art, lends itself to being manufactured for properties of substantially greater rigidity and stiffness than the coupling member 25. Preferably, the rod 21 is formed of a tough, rigid and heat resistant polymeric material such as for example Nylon 6/6, with glass fiber reinforcement and containing sufficient polytetrafluoroethylene (PTFE) to impart surface characteristics of lubricity and low coefficient of friction between the outer surface of the rod and the recoil spring 22 with consequent longer wear life. Nylon 6/6, the base material, provides abrasion and chemical resistance while the glass fibers provide added stiffness and strength to the rod.

The recoil spring 22 may be formed of any suitable spring metal such as a chrome silicon wire. As shown in FIGS. 2 and 3, the spring is preferably one having a rectangular cross-section rather than circular cross-section to reduce the solid height or length of the spring when fully compressed which enables the reduction in the overall length required for the recoil mechanism. The chrome silicon is used to withstand heat and spring loads applied to the recoil spring 22 and to maintain spring load over time.

The flange 20 which serves as a seat for the inner end 27 of the recoil spring 22, comprises a portion of a female coupling member 25. The coupling member comprises the flange 20 disposed at one end of a generally cylindrical tubular shaft 40 coaxially extending from the center of the flange 20. A bore or socket 42 within the shaft 40 provides means for coupling or connecting the member onto the shank portion of the rod 21. As shown, the inner cylindrical bore 42 of the socket 40 preferably extends through the entire member 25. An annular projection or shoulder 43 is formed within the socket 42 and is dimensioned and disposed to interfit with the neck 31 of the shank 24. The leading end 45 of the shoulder 43 is beveled to be engaged in surface-to-surface relationship by the chamfer 33 on the leading edge of the head portion 32 of the shank 24 when the parts are telescopically fitted. The inner edge 44 of the projection 43 is generally perpendicular to the axis of the member 25 and rod 21 whereby the two edges 34 and 44 are adapted to provide means for locking the member 25 and the rod 21 together in assembled relation. The outer diameter of the tubular portion 46 of the flange member is of generally the same outer diameter as the rod 21 so that the inner edge 53 of the spring will not bind or catch on the interface between the two parts but rather its coils will be able to move easily and smoothly over the surface of the rod between the two flanges 20 and 23 as the spring is expanded and compressed.

The discrete coupling member 25 is preferably formed of a resilient polymeric material such as Nylon 6/6 containing an elastomer. The elastomer imparts to the polymer necessary resilience to enable the socket portion 40 of the member 25 to yield outwardly to accept therein the head portion 32 of the shank 24 and thereafter to snap back so as to lock the two parts together. This combination of materials also provides shear strength to prevent the annular shoulder 43 of the socket portion 40 from shearing off as well as having sufficient form stability to ensure that the shoulder will be securely interlocked permanently with neck 31 of the rod despite the expansive force of the recoil spring 22 being exerted outwardly against the flanges 20 and 23 tending to pull apart the two members.

As best illustrated in FIGS. 2 and 3, the recoil mechanism is assembled by simply fitting the recoil spring 22 on the rod 21 and then press fitting the coupling member 25 thereon. During the process of fitting the shank 24 of the rod into the socket 40 of the flange member, the beveled outer edge 33 of the head 32 of the shank engages the beveled surface 45 of the shoulder 43 of the flange member. By applying an axially force or impact against the opposite ends of the rod, the leading edge chamfer 33 of the head 32 will exert longitudinal and radial components of force to cause the tubular portion 46 of the flange member to expand radially outward thus allowing the head portion 32 of the shank to move over the inner stirface of the annular projection 43 until the head moves beyond the inner edge 27. At that point, the projection 43 will be disposed in registered longitudinal relation with the neck or recess 31 an the projection 43 will snap-fit into the recess because of the resilient nature of the tubular portion of the member 25 and permanently connect the two parts together.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. An improved recoil mechanism for a semi-automatic handgun which includes a slide reciprocally movable on a frame and a metallic recoil compression spring is coaxially disposed on a rod with one end thereof engaged with the slide and an other end engaged with the frame so that the spring will be compressed in response to movement of the slide upon recoil of the gun, the improvement comprising an elongated polymeric rod having a longitudinal axis and comprising a first flange disposed in generally perpendicular relation to said axis and being integral with one end thereof and providing a seat for one end of the spring and a second flange fitted onto a shank portion coaxially disposed on the other end of said rod with said second flange being in generally parallel relation to said first flange and serving as a seat for the other end of the spring, said second flange being part of a member comprising a socket coaxial with the second flange and adapted to receive therein said shank portion of said rod for securely coupling together said rod and second flange for ease of assembly of the polymeric rod and said recoil spring and in which the rod member is generally of non-circular cross-section intermediate said first and second flanges and comprising an inner core and a plurality of beam portions extending radially outwardly of said core in circumferentially spaced relation for improved longitudinal strength to weight ratio of and heat dissipation by said rod.

2. An improved recoil mechanism for a semi-automatic handgun, as set forth in claim 1, and in which said radial beam portions of said rod are of generally rectangular configuration and each of which terminate in a generally cylindrical surfaces coaxial with said recoil spring.

3. An improved recoil mechanism for a semi-automatic handgun, as set forth in claim 2, and in which the cross-section of the rod is of generally cruciform configuration.

4. An improved recoil mechanism for a semi-automatic handgun as set forth in claim 1 and in which said shank portion comprises a generally cylindrical portion including a head having a beveled outer edge and an annular neck portion of reduced diameter and in which said socket of the flange member includes an inner cylindrical bore in which is provided an annular shoulder having a reduced inner diameter adapted to interfit with said the neck of the shank.

5. An improved recoil mechanism for a semi-automatic handgun as set forth in claim 4 and in which the rod is fabricated of a high strength polymer with glass fiber impregnated therein to provide a rod characterized by longitudinal stiffness and shear strength.

6. An improved recoil mechanism for a semi-automatic handgun as set forth in claim 5, and in which the rod is impregnated with a polytetrafluoroethylene to impart thereto a property of lubricity and low coefficient of friction for easy sliding movement thereover of said recoil spring.

7. An improved recoil mechanism for a semi-automatic handgun as set forth in claim 6 and in which the socket of said member includes therein an inwardly extending coupling member for interengagement with a recess disposed on the shank for securely holding said rod and second flange together.

8. An improved recoil mechanism for a semi-automatic handgun as set forth in claim 7 and in which the flange member is composed of a polymeric material which includes an elastomer which imparts radial resilience to the socket to permit the socket to flex outwardly to enable said coupling member to be moved into registered relation with the recess of said shank for intercoupling therewith.

9. An improved recoil mechanism for a semi-automatic handgun as set forth in claim 8 and in which the coupling projection in the socket of the flange member includes a beveled leading edge and said recess of the shank is defined by a head portion forwardly and of larger diameter than the recess, said head including at its leading edge a chamfer adapted to engage the beveled edge of the projection to cause the socket to be flexed outwardly by a radial component of force generated when the socket is forced axially onto the shank portion of the rod.

* * * * *